United States Patent [19]

Watkin

[11] 3,992,008

[45] Nov. 16, 1976

[54] PLAYING RACQUET HAVING AN ADJUSTABLE NET

[76] Inventor: Matthew Madys Watkin, c/o 9th Ave. and Homestead Road, Rivonia, Sandton, South Africa

[22] Filed: Nov. 3, 1975

[21] Appl. No.: 628,337

[30] Foreign Application Priority Data

Nov. 11, 1974 South Africa ..... 74/7214

[52] U.S. Cl. ..... 273/96 R; 273/67 R; 124/5

[51] Int. Cl.[2] ..... A63B 71/00

[58] Field of Search ..... 273/67 R, 73 R, 73 C, 273/73 G, 734, 75, 96 R; 124/5

[56] References Cited

UNITED STATES PATENTS

| | | | |
|---|---|---|---|
| 1,964,232 | 6/1934 | Tromblee | 273/96 R |
| 2,463,621 | 3/1949 | Herzog | 273/73 G |
| 3,431,626 | 3/1969 | Carlton | 273/73 H |
| 3,614,100 | 10/1971 | Spitz | 273/75 |
| 3,751,034 | 8/1973 | Portz | 273/DIG. 7 |
| 3,871,653 | 3/1975 | Sambos | 273/96 R |
| 3,895,800 | 7/1975 | King | 273/96 R |

FOREIGN PATENTS OR APPLICATIONS

| | | | |
|---|---|---|---|
| 220,286 | 5/1909 | Germany | 273/96 R |

*Primary Examiner*—Richard C. Pinkham
*Assistant Examiner*—Marvin Siskind
*Attorney, Agent, or Firm*—Dressler, Goldsmith, Clement, Gordon & Shore, Ltd.

[57] ABSTRACT

The invention provides for playing equipment comprising a ball and a racquet. The racquet includes a length of sturdy tubular material shaped into a shaft, a handle at one end of the shaft and an annular head at the other end of the shaft, and a loose net secured to the head to extend across the opening defined in the head and forming a concave ball-receiving playing web in which a ball which is smaller than the opening defined in the head is receivable. Basic maneuvers such as picking up the ball, catching it and throwing it can be executed with the racquet.

2 Claims, 3 Drawing Figures

PLAYING RACQUET HAVING AN ADJUSTABLE NET

This invention relates to playing equipment and to a method of manufacture therefor. In particular, the invention relates to playing equipment for use with a ball, or the like.

According to the invention there is provided playing equipment comprising a racquet including a length of sturdy tubular material shaped into a shaft, a handle at one end of the shaft and an annular head at the other end of the shaft, and a loose net secured to the head to extend across the opening defined in the head and forming a concave ball-receiving playing web in which a ball which is smaller than the opening defined in the head is receivable.

The tubular material may be metal which is bent into the shape of the head, shaft and handle with a portion of the tubular material overlapping from the head over the shaft, the overlapping portion being secured to the shaft. Alternatively, the tubular material may be a synthetic plastic material.

Conveniently, the net comprises flexible string-like elements looped between the head and a central noose which is also a flexible string-like element. The concavity of the net may be adjustable by adjusting the central noose.

The handle may have a larger cross-sectional dimension than the cross-sectional dimension of the shaft and may be of wood covered with towelling material.

The head may substantially be circular and may have a diameter equal to about one half of the combined length of the shaft and the handle.

The invention also extends to playing equipment in accordance with the invention in combination with a hollow air-filled ball.

Still further the invention extends to a method of manufacturing playing equipment which includes the steps of forming a length of sturdy tubular material into an annular head, a shaft and a handle, affixing a loose net to the head to extend across the opening defined in the head to form a concave ball-receiving playing web.

The method may include providing the tubular material in metal and bending it into the shape of the head, shaft and handle with a portion of the tubular material overlapping from the head over the shaft, the overlapping portion being secured to the shaft.

The invention will now be described by way of an example with reference to the accompanying drawings, in which.

Figure 1:
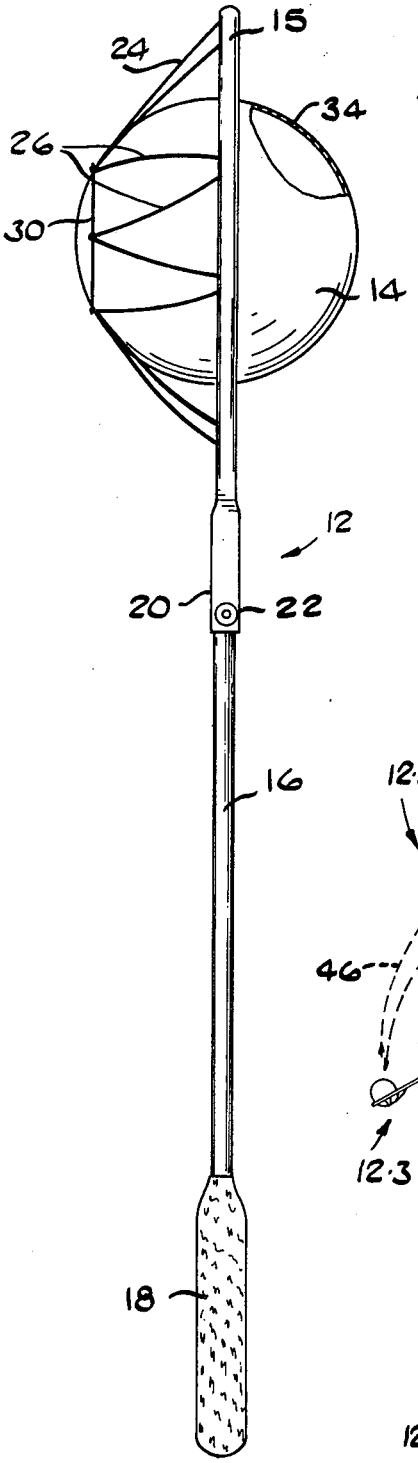
FIG. 1 shows a side view of playing equipment in accordance with the invention including a racquet and ball.
Figure 2:
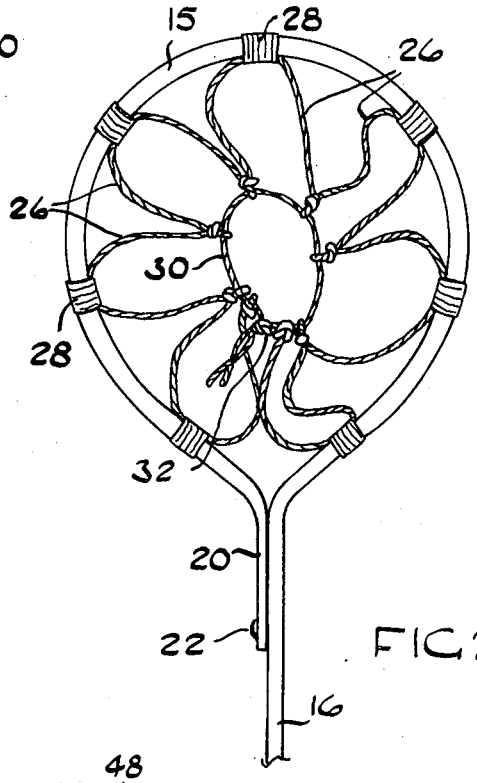
FIG. 2 shows a fragmentary front view of the racquet shown in FIG. 1.

Referring to FIGS. 1 and 2, reference numeral 10 indicates the playing equipment in general. It comprises a racquet 12 and a hollow air-filled ball 14 which is of rubber or of a synthetic plastic material.

The racquet 12 has a circular head 15, a shaft 16 and a handle 18. The entire head 15, shaft 16 and handle 18 are shaped from a length of tubing of a sturdy material. The material may be metal and is preferably a light metal having sufficient strength, such as aluminum. Alternatively, the tubing may be of a suitable synthetic plastic material. When the tubing is of aluminum, the length of tubing is shaped by being bent in a former (not shown). It is so shaped that a portion 20 of the tubing overlaps the shaft 16. The overlapping portion 20 is flattened and is secured to the shaft 16 by means of a rivet 22. The handle 18 is of wood covered with towelling material.

A loose net 24 is secured to the round head 15 to form a concave ball-receiving playing web extending across the opening defined by the head 15. The net 24 comprises a plurality of loops 26 of string of a suitably robust material, for example, a synthetic plastic material such as nylon. The loops 26 are secured to the head 15 by means of adhesive tape 28. The inner regions of the loops 26 are threaded through a central noose 30 which is tied by means of a knot 32.

FIG. 1 shows the concavity of the net 24 in the side view of the racquet 12. The ball 14 is receivable in the net 24 which forms a flexible playing web. The concavity of the net 24 is adjustable by loosening the knot 32 and adjusting the length of the central noose 30 and then retying the knot 32. In order to achieve effective playing, the concavity of the net 24 must be approximately as shown in FIG. 1, i.e., so that when the ball 14 is received in the net 24 it projects about halfway from the head 16.

The tubing from which the racquet 12 is formed is about 1 cm in diameter. The head 15 is about 19 cm in diameter while the over all length of the racquet 12, including the head 15, the shaft 16 and the handle 18, is about 67 cm.

The ball 14 is hollow air-filled and is of a example pvc. material, for examplepvc. The thickness of the shell 34 of the ball as shown in FIG. 1 is about 1.5 mm.

Figure 3:
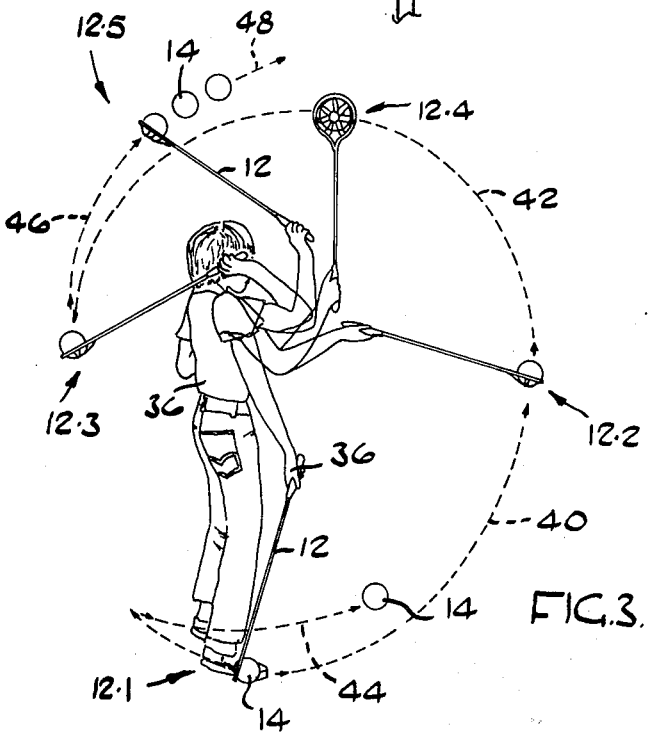
FIG. 3 illustrates the playing equipment shown in FIG. 1 in use.

FIG. 3 shows the racquet 12 and the ball 14 in use by a player 36. Basically, three maneuvers are executed with the racquet 12, namely, picking up the ball, throwing the ball and catching the ball. Many different techniques and strokes may be employed in executing these three basic maneuvers. Some of these are illustrated in FIG. 3. The picking up of the ball is illustrated by 12.1. In this maneuver the hand 38 of the player 36 is in front of the ball 14. The wrist is flicked to swing the racquet 12 forward to the position 12.2 along the path 40. The maneuver is continued over the player's head to the position 12.3 along the path 42.

Another maneuver is to throw the ball 14 under arm along the path 44. Yet another maneuver is to cradle the ball as shown in 12.4 which is used to get the ball in the racquet for an overhead throw without dropping the ball. An overhead throw is executed from the position 12.5, the racquet being moved along the path 46 and the ball thus being propelled along the path 48.

The ball 14 may be caught in many ways, for example, under arm which is the reverse of executing the under arm throw along the path 44. The ball may also be caught overhead in the position shown by 12.5.

The playing equipment comprising the racquet 12 and the ball 14 is all that is required for playing a game with the equipment. No additional equipment is required. Two or more players may participate. Points are scored for accuracy of throwing and for catching.

What is claimed is:

1. Playing equipment comprising a racquet including a length of sturdy tubular material shaped into a shaft, a handle at one end of the shaft and an annular head at the other end of the shaft, a loose net secured to the head to extend across the opening defined in the head and forming an adjustable concave ball-receiving playing web in which a ball which is smaller than the opening defined in the head is receivable, said net comprising flexible string-like elements looped between the head and a central noose which is also a flexible string-like element.

2. Playing equipment according to claim 1, in which the concavity of the net is adjustable by adjusting the central noose.

* * * * *